US005421292A

United States Patent [19]

Hoffman et al.

[11] Patent Number: 5,421,292

[45] Date of Patent: Jun. 6, 1995

[54] CYLINDER HEAD ASSEMBLY

[75] Inventors: Ronald J. Hoffman, Phoenix; Robert G. Everts, Chandler, both of Ariz.

[73] Assignee: Ryobi Outdoor Products, Chandler, Ariz.

[21] Appl. No.: 97,075

[22] Filed: Jul. 23, 1993

[51] Int. Cl.[6] ..... F02F 1/06

[52] U.S. Cl. ..... 123/41.69; 123/193.5

[58] Field of Search ..... 123/41.69, 193.5, 195 R, 123/90.61

[56] References Cited

U.S. PATENT DOCUMENTS

| | | | |
|---|---|---|---|
| 1,874,338 | 8/1932 | Niven . | |
| 2,529,616 | 11/1950 | Kraker . | |
| 2,970,584 | 2/1961 | Wünsche et al. | 123/41.69 |
| 3,064,634 | 11/1962 | Tyce et al. | 123/41.74 |
| 4,100,909 | 7/1978 | Nakano et al. | 123/196 AB |
| 4,345,552 | 8/1982 | Kasting et al. | 123/90.38 |
| 4,404,936 | 9/1983 | Tatebe et al. | 123/196 R |
| 4,554,893 | 11/1985 | Vecellio | 123/41.83 |
| 4,601,267 | 7/1986 | Kronich | 123/90.33 |
| 4,649,874 | 3/1987 | Sonoda et al. | 123/90.36 |
| 4,662,322 | 5/1987 | Tamba et al. | 123/41.86 |
| 4,762,098 | 8/1988 | Tamba et al. | 123/90.33 |
| 4,821,694 | 4/1989 | Hesterberg et al. | 123/195 R |
| 4,881,496 | 11/1989 | Kronich | 123/90.33 |
| 5,058,542 | 10/1991 | Grayson et al. | 123/90.38 |

FOREIGN PATENT DOCUMENTS

| | | | |
|---|---|---|---|
| 900899 | 11/1945 | France | 123/41.69 |
| 25962 | 2/1986 | Japan | 123/568 |

OTHER PUBLICATIONS

"The Little Engine That Could," *Popular Science* (Mar., 1993) p. 90.

*Primary Examiner*—Noah P. Kamen
*Attorney, Agent, or Firm*—Brooks & Kushman

[57] ABSTRACT

A small four cycle internal combustion engine is disclosed having a cylinder head assembly which comprises a cylinder head cooperating with a cylinder block of the engine, and a rocker box connected to the cylinder head so as to define an air passage therebetween through which air may pass. The cylinder head has cooling fins projecting into the air passage between the cylinder head and the rocker box and aligned generally transversely to a line extending between the axes of the intake and exhaust valves. The air passage preferably extends between an intake port and an exhaust port of the engine, and above an exhaust gas recirculation port extending between the intake and exhaust ports. A pair of push rod tubes are integral with the rocker box and extend between the rocker box and a crankcase of the engine externally of the cylinder block. The engine of the present invention also includes a cam tower assembly comprising a base member and a pair of parallel shafts extending from the base member. One of the shafts functions as a camshaft and has a unitary cam gear and cam rotatably supported thereon. The other shaft is a follower shaft and has a pair of cam followers rotatably supported thereon.

44 Claims, 4 Drawing Sheets

CYLINDER HEAD ASSEMBLY

TECHNICAL FIELD

This invention relates to internal combustion engines, and more particularly to a two-piece rocker box and cylinder head assembly and a cam tower assembly for a small four cycle engine.

BACKGROUND ART

Small internal combustion four cycle engines are known which have a rocker box and a separately formed cylinder head. U.S. Pat. No. 4,601,267 to Kronich, for example, discloses a rocker box base fastened on a cylinder head integrally formed with a cylinder block. Similarly, U.S. Pat. No. 5,058,542 to Grayson et al. discloses a thermoplastic or die cast aluminum inner rocker box cover bolted on a cylinder head.

It is also known to make the cylinder head and rocker box as a one piece, integrally formed cylinder head assembly. The manufacture of such a cylinder head assembly typically involves a complex casting which may require four or more slides to form the intricate air passages and cooling fins by which heat is dissipated from the hottest part of the engine. Because the casting process is so difficult, however, and particularly when it is performed on a very small scale for single cylinder engines, the resulting wall thicknesses are frequently not uniform. Additionally, it is difficult or impossible to cast the rocker box with integral push rod tubes.

Furthermore, the casting process may permit only a single slot on the order of a millimeter wide to be formed on either side of the spark plug and between the cylinder head and the rocker box. Since engine cooling is a function of the air flow through this passage, such a limited air path restricts cooling efficiency. The presence of disuniformly thick walls compounds this problem.

Additionally, non-overhead camshaft small four cycle engines which use cam followers in the valve train typically have a camshaft on which are mounted the camgear and one or more cams, and a follower shaft on which are mounted the cam followers. Conventionally, the follower shaft is mounted to the cylinder block, and the camshaft is mounted to the crankcase. However, this construction introduces variances into the desired operation of the valve train for several reasons. Initially, there is often a variation in the center distance between the shafts because of manufacturing tolerances in the formation of the cylinder block, crankcase and valve train components. Additionally, there is some variance in the width of the gasket which typically separates the cylinder block and the crankcase.

These variances result in a deviation from the optimal functioning of the valves, which can diminish the efficient operation and/or emissions performance of the engine. These variances are magnified in smaller engines such as single cylinder engines used for lawn and garden work. Further reductions in emissions output are known to be obtainable by engine exhaust gas recirculation. However, a simple and cost effective system for exhaust gas recirculation in small engines is not readily available.

SUMMARY OF THE INVENTION

The present invention is a small four cycle internal combustion engine having a cylinder head assembly which comprises a cylinder head cooperating with a cylinder block of the engine, and a rocker box connected to the cylinder head so as to define an air passage therebetween through which air may pass. The cylinder head has cooling fins projecting into the air passage between the cylinder head and the rocker box and aligned generally transversely to a line extending between the axes of the intake and exhaust valves. The air passage preferably extends between an intake port and an exhaust port of the engine, and above an exhaust gas recirculation port extending between the intake and exhaust ports. A pair of push rod tubes are integral with the rocker box and extend between the rocker box and a crankcase of the engine externally of the cylinder block.

The engine of the present invention also includes a cam tower assembly comprising a base member and a pair of parallel shafts extending from the base member. One of the shafts functions as a camshaft and has a unitary cam gear and cam rotatably supported thereon. The other shaft is a follower shaft and has a pair of nested cam followers rotatably supported thereon. The cam tower assembly is adapted to be attached to the engine such that the rotation of the cam actuates the followers, which in turn operate the remainder of the valve train.

Accordingly, it is an object of the present invention to provide a cylinder head assembly of the type described above having a die cast aluminum cylinder head and a discrete, die cast aluminum or magnesium rocker box with integral push rod tubes.

Another object of the present invention is to provide a cylinder head assembly of the type described above having improved cooling characteristics.

Another object of the present invention is to provide a cylinder head assembly of the type described above which can be simply and inexpensively manufactured.

Still another object of the present invention is to provide a cam tower assembly of the type described above in which the distance between the camshaft and the follower shaft can be closely controlled.

Still another object of the present invention is to provide a small internal combustion engine of the type described above having an exhaust gas recirculation port extending between an intake port and an exhaust port of the engine.

These and other objects, features, and advantages of the present invention are readily apparent from the following detailed description of the best mode for carrying out the invention when taken in conjunction with the accompanying drawings.

BEST MODE FOR CARRYING OUT THE INVENTION

Figure 1:
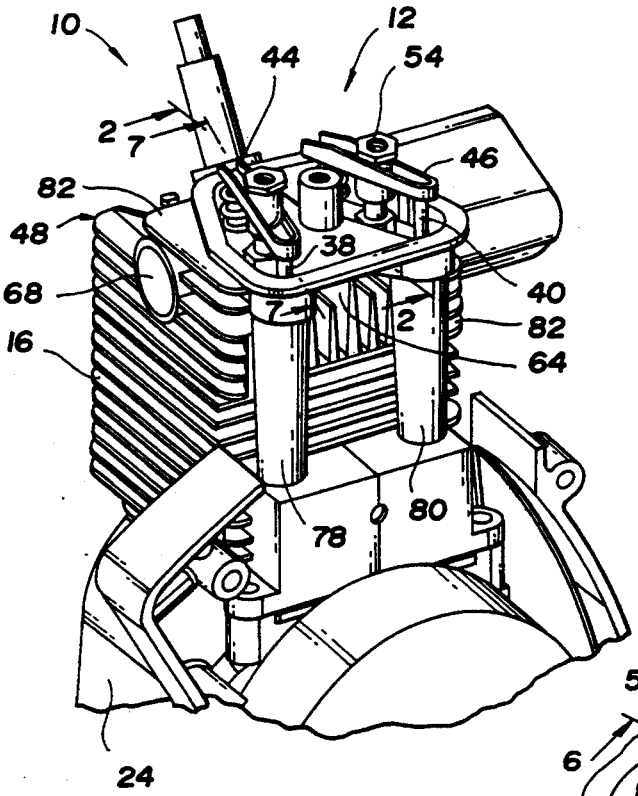
FIG. 1 is a partial perspective view of a small four cycle internal combustion engine according to the present invention.

With reference to the drawings, the preferred embodiments of the present invention will be described. FIGS. 1 through 7 show a small one-cylinder, four cycle engine 10 according to the present invention preferably having a displacement of between about 20 and 80 cubic centimeters. The engine 10 comprises a cylinder head assembly 12 and a piston 14 reciprocable in a cylinder block 16.

Figure 2:
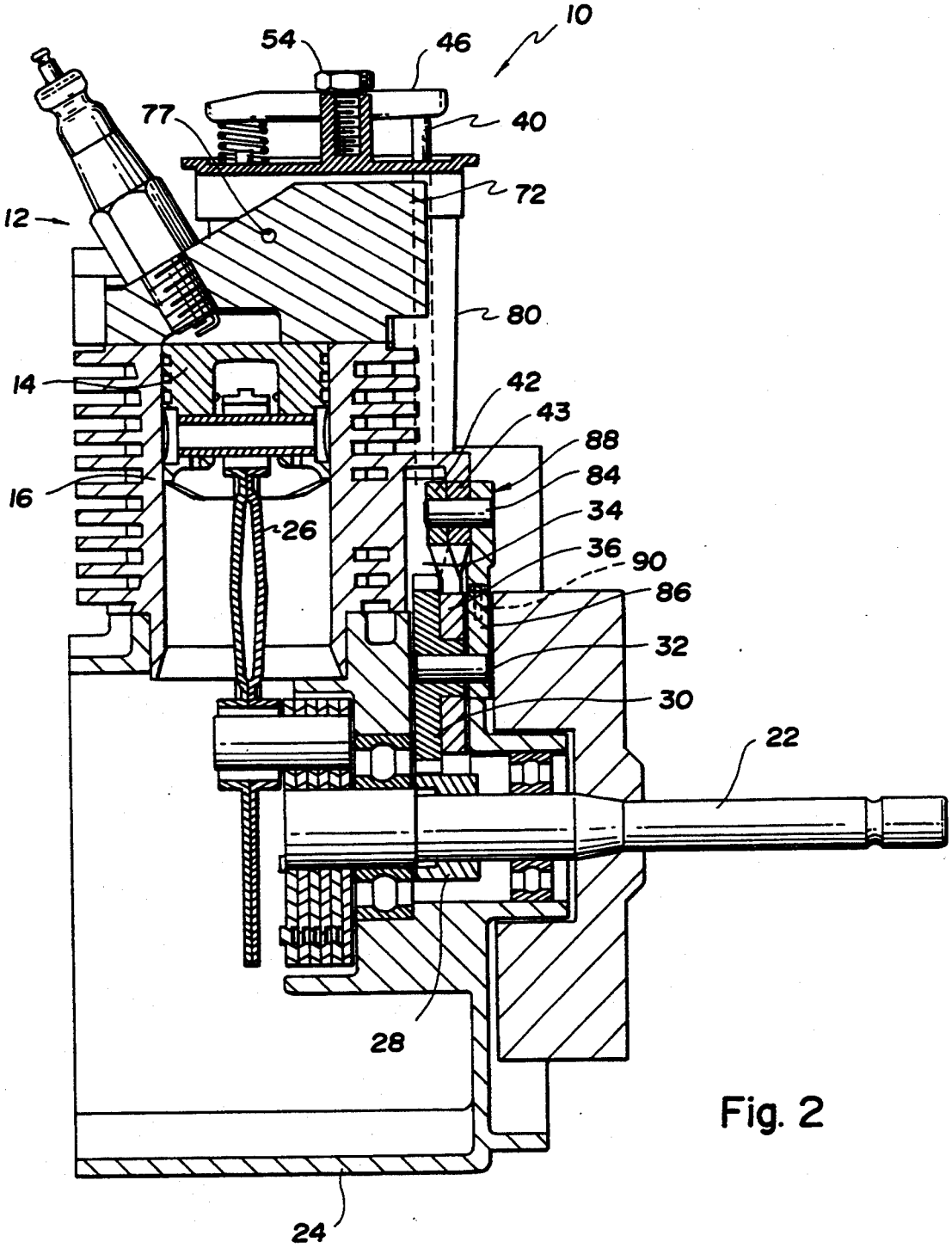
FIG. 2 is a cross sectional view of the engine taken along line 2—2 in FIG. 1.
Figure 5:
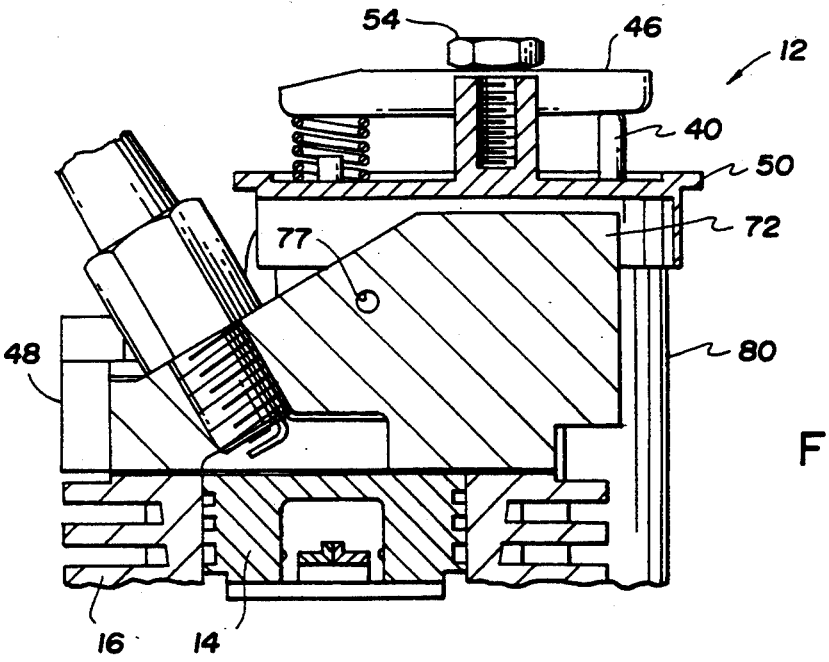
FIG. 5 is an enlarged partial cross sectional view of the cylinder head assembly shown in FIG. 2.
Figure 6:
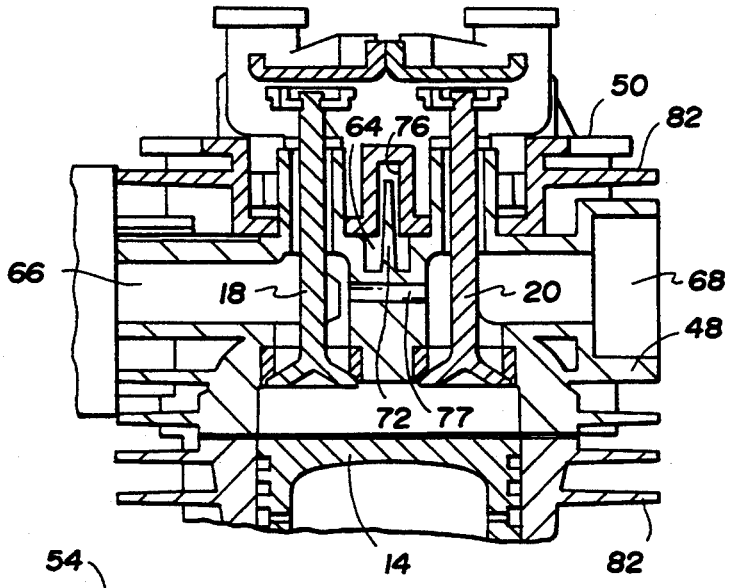
FIG. 6 is a partial cross sectional view of the cylinder head assembly taken along line 6—6 in FIG. 3.
Figure 7:
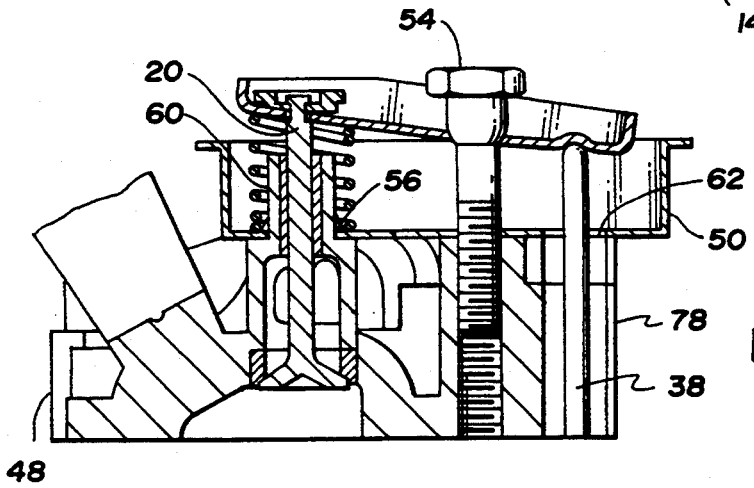
FIG. 7 is another enlarged partial cross sectional view of the cylinder head assembly taken along line 7—7 in FIG. 1.

The piston 14 is operatively connected to actuate an intake valve 18 and an exhaust valve 20. As shown in FIG. 2, reciprocation of the piston 14 imparts rotation to a cantilevered crankshaft 22 disposed in a crankcase 24 through a connecting rod 26, as is well known in the art. A crankgear 28 mounted on the crankshaft 22 in turn meshes with a camgear 30 mounted on a camshaft 32 in a valve drive chamber 34 of the crankcase 24 to drive a single lobe cam 36 at one-half engine speed. Rotation of the cam 36 is translated to reciprocable motion to reciprocate a pair of pushrods 38 and 40 by a pair of frog-leg shaped followers 42 and 43, as disclosed in pending U.S. patent application Ser. No. 08/021,496. The push rods 38 and 40 operate through rocker arms 44 and 46 to respectively actuate the exhaust valve 20 and the intake valve 18. Of course, one skilled in the art will appreciate that a conventional construction including tappets can be provided to perform the function of the followers 42 and 43.

Figure 3:
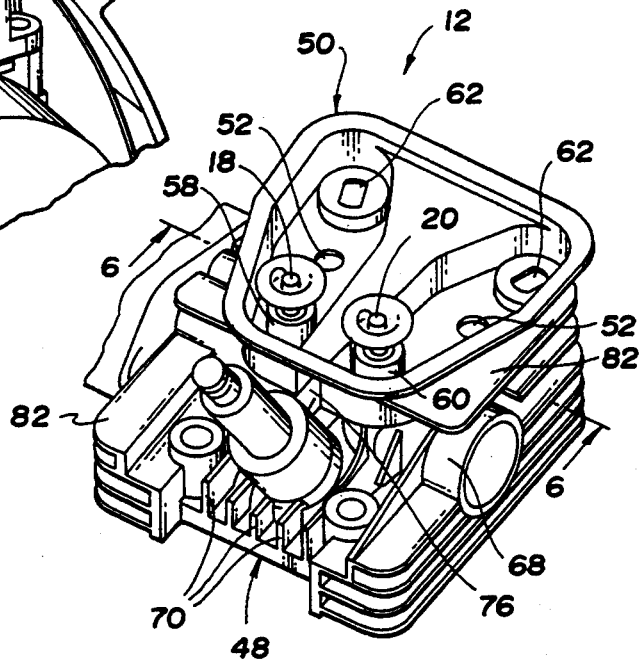
FIG. 3 is a perspective view of a cylinder head assembly of the engine.
Figure 4:
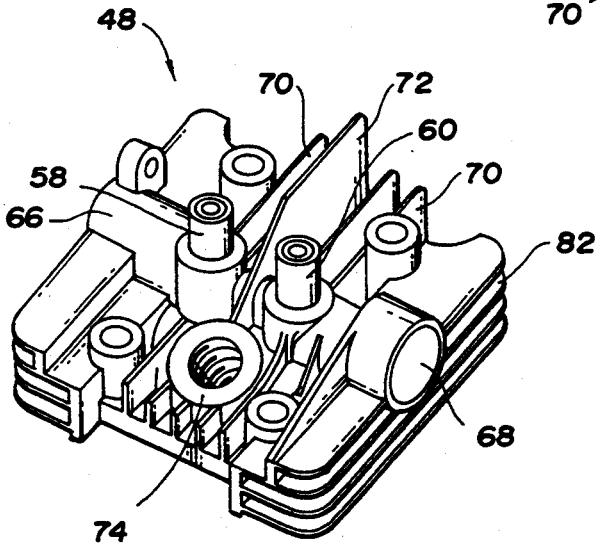
FIG. 4 is a perspective view of a cylinder head of the engine.

As shown in FIGS. 3 through 7, the cylinder head assembly 12 includes a unitary, die cast aluminum cylinder head 48 adapted to cooperate with the cylinder block 16, and a rocker box 50. The rocker box 50 is also a unitary die cast aluminum or magnesium part, and is adapted to at least partially house the rocker arms 44 and 46. The rocker box 50 has a first pair of holes 52 therethrough adapted to receive means, such as bolts or rocker studs, for connecting the rocker box to the cylinder head 48. In a preferred embodiment shown in FIG. 1, rocker studs 54 extend through the cylinder head 48 to secure the entire cylinder head assembly 12 to the cylinder block 16. The rocker box 50 also has a second pair of holes 56 therethrough adapted to respectively receive a pair of valve guides 58 and 60 projecting from the cylinder head 48. A third pair of holes 62 are formed in the rocker box 50 for receiving the push rods 38 and 40. If the rocker box is formed from aluminum, the holes 62 can be cast in a generally oval shape, as shown in FIG. 3, to act as push rod guides. If the rocker box is formed from magnesium, stamped steel guide plates having generally oval holes therethrough are preferably added to act as push rod guides.

The rocker box 50 is connected to the cylinder head 48 so as to define an air passage 64 therebetween through which cooling air may flow. The air passage 64 preferably extends between cross flow intake and exhaust ports 66 and 68, respectively, formed in the cylinder head 48. The cylinder head 48 has a plurality of cooling fins 70 which project into the air passage 64 between the cylinder head and the rocker box 50. In particular, a main cooling fin 72 projects rearwardly from a spark plug boss 74 and up into an expanding groove 76 formed in the bottom of the rocker box 50. All the cooling fins 70, including the main cooling fin 72, are aligned generally transversely to an imaginary line extending between the axes of the intake and exhaust valves 18 and 20.

The cylinder head 48 also has drilled therein an exhaust gas recirculation (EGR) port 77. The EGR port extends between the innermost sections of the intake port 66 and the exhaust port 68, and generally below the air passage 64. The EGR port 77 is preferably generally coaxial with the exhaust port and offset slightly from the axis of the intake port as viewed from above, although this arrangement may be reversed. The EGR port 77 preferably has a constant circular cross-section with a diameter of about 1.25 millimeters. Throughout the range of engine operation, and in particular at the normal operational speed of about 7-8000 rpm, approximately 10% of the total exhaust gases produced by the engine are drawn back through the EGR port 77 to the intake port 66 for mixing with the incoming fuel-air mixture.

A pair of elongated push rod tubes 78 and 80 in which push rods 38 and 40 are respectively reciprocable are integrally formed with the rocker box 50. The push rod tubes 78 and 80 extend, externally of the cylinder block 16, from the rocker box 50 to sealingly cooperate with the valve drive chamber 34 of the crankcase 24. Both the cylinder head 48 and the rocker box 50 also have a plurality of horizontal cooling fins 82 disposed at least partially around their perimeters, preferably proximate the intake and exhaust ports 66 and 68 and adjacent the push rod tubes 78 and 80. Because the cylinder head and the rocker box of the present invention are discrete components that can be separately cast, the cylinder head assembly has relatively uniform wall thicknesses throughout, which facilitates engine cooling.

As best shown in FIG. 2, the pin forming the camshaft 32 and a generally parallel pin forming a follower shaft 84 extend from a bracket or base member 86 to comprise a carrier 88. The base member 86 is preferably formed as an alloy steel powdered metal part. The cam gear 30 and the cam 36, which are preferably formed as a unitary powdered metal part, are rotatably supported on the camshaft 32. Likewise, the followers 42 and 43 are rotatably supported on the follower shaft 84. Together, the carrier 88, cam gear 30 and cam 36, and the followers 42 and 43 comprise a cam tower assembly. Because the shafts 32 and 84 extend from a common base member 86, rather than being secured separately to the cylinder block and/or the crankcase, the distance between the shafts is more closely controllable. This eliminates the assembly and tolerance problems involved in the conventional method of assembly where the cam and the follower are assembled as individual components on separate pins on the crankcase and the cylinder assembly, respectively. The present construction also eliminates potential oil leak areas often found in conventional designs where the walls were drilled to accept the pins therethrough.

The cam tower assembly is preferably attached to the engine by means of two bolts or socket head screws 90 extending through open grooves in the base member 86 and into the crankcase 24. The crankcase can be either cored or drilled and tapped to accept the screws. This structure makes the cam tower assembly easily serviceable because with the removal of only the screws 90, the entire assembly can be removed from the cranckcase. While the cam tower assembly is shown in FIG. 2 with the base member 86 proximate the flywheel and the cam gear 30 proximate the cylinder block, it should be appreciated that a mirror image of this arrangement with the base member proximate the cylinder block and the cam gear proximate the flywheel is equally feasible.

Figure 8:
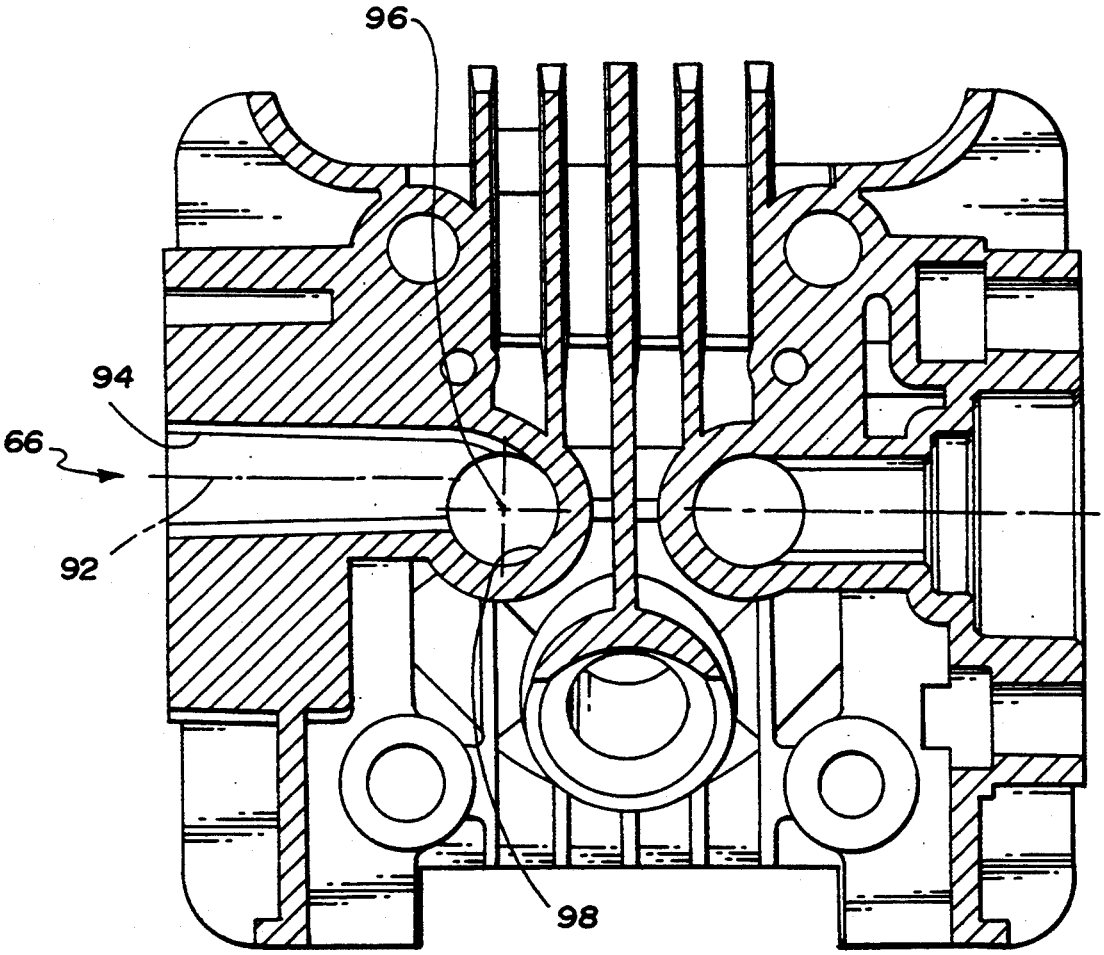
FIG. 8 is another cross sectional view of the cylinder head.

FIG. 8 shows that the axis 92 of the horizontal portion 94 of the intake port 66 is not aligned with the axis 96 of the vertical portion 98 of the intake port. Because of this offset intake port feature, the incoming fuel-air mixture is deflected or pre-swirled by the wall of the vertical portion 98 of the intake port around the stem of the intake valve, and continues to swirl as it is introduced into the combustion chamber. The swirling mixture thus created burns more quickly and/or completely when subsequently ignited by the spark plug. As an alternative to offsetting the intake port to induce a clockwise swirl in the cylinder as viewed from above, the intake port can be offset below the horizontal axis of the intake port so as to create a counterclockwise swirl.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

What is claimed is:

1. A cylinder head assembly for a small four cycle internal combustion engine, the engine having a piston reciprocable in a cylinder block, an intake valve and an exhaust valve, the cylinder head assembly comprising:

a cylinder head adapted to cooperate with the cylinder block;

a rocker box connected to the cylinder head so as to define a passage therebetween allowing air to flow completely through the passage;

a pair of push rod tubes integrally formed with the rocker box extending between the rocker box and the crank case; and the cylinder head having cooling fins projecting into the passage between the cylinder head and the rocker box and aligned generally transversely to a line extending between the axes of the intake and exhaust valves, the passage extending essentially in a straight line.

2. The cylinder head assembly of claim 1 further comprising an intake port and an exhaust port formed in the cylinder head, the passage extending between the intake port and the exhaust port.

3. The cylinder head assembly of claim 2 wherein the cylinder head has an exhaust gas recirculation port extending between the intake and the exhaust ports and generally below the passage.

4. The cylinder head assembly of claim 1 wherein the push rod tubes extend externally of the cylinder block.

5. The cylinder head assembly of claim 1 wherein the rocker box has a first pair of holes therethrough adapted to receive means for connecting the rocker box to the cylinder head.

6. The cylinder head assembly of claim 5 wherein the rocker box is connected to the cylinder head by bolts extending through the first pair of holes.

7. The cylinder head assembly of claim 1 wherein the rocker box has a second pair of holes therethrough adapted to respectively receive a pair of valve guides projecting from the cylinder head.

8. The cylinder head assembly of claim 1 wherein the rocker box has a third pair of holes therethrough including means for respectively guiding a pair of push rods.

9. The cylinder head assembly of claim 8 wherein the holes are oval shaped.

10. The cylinder head assembly of claim 1 wherein the rocker box has cooling fins disposed at least partially around its perimeter.

11. The cylinder head assembly of claim 1 wherein the rocker box is die cast.

12. The cylinder head assembly of claim 1 wherein the rocker box comprises aluminum.

13. The cylinder head assembly of claim 1 wherein the rocker box comprises magnesium.

14. The cylinder head assembly of claim 1 wherein the cylinder head is die cast.

15. The cylinder head assembly of claim 1 wherein the cylinder head comprises aluminum.

16. A cylinder head assembly for a small four cycle internal combustion engine, the engine having a crankcase, a piston reciprocable in a cylinder block, an intake valve and an exhaust valve, the cylinder head assembly comprising:

a cylinder head adapted to cooperate with the cylinder block; and a rocker box connected to the cylinder head and having integrally formed therewith a pair of elongated push rod tubes extending to sealingly cooperate with the crankcase.

17. The cylinder head assembly of claim 16 wherein the push rod tubes extend externally of the cylinder block.

18. The cylinder head assembly of claim 16 wherein the cylinder head has cooling fins projecting into an air passage defined between the cylinder head and the rocker box.

19. The cylinder head assembly of claim 18 wherein the cooling fins are aligned generally transversely to a line extending between the axes of the intake and exhaust valves.

20. The cylinder head assembly of claim 18 further comprising an intake port and an exhaust port formed in the cylinder head, the air passage extending between the intake port and the exhaust port.

21. The cylinder head assembly of claim 20 wherein the cylinder head has an exhaust gas recirculation port extending between the intake and the exhaust ports and generally below the air passage.

22. The cylinder head assembly of claim 16 wherein the rocker box has a first pair of holes therethrough adapted to receive means for connecting the rocker box to the cylinder head.

23. The cylinder head assembly of claim 22 wherein the rocker box is bolted to the cylinder head.

24. The cylinder head assembly of claim 16 wherein the rocker box has a second pair of holes therethrough adapted to respectively receive a pair of valve guides projecting from the cylinder head.

25. The cylinder head assembly of claim 16 wherein the rocker box has cooling fins disposed at least partially around its perimeter.

26. The cylinder head assembly of claim 16 wherein the rocker box is die cast.

27. The cylinder head assembly of claim 16 wherein the rocker box comprises aluminum.

28. The cylinder head assembly of claim 16 wherein the rocker box comprises magnesium.

29. The cylinder head assembly of claim 16 wherein the cylinder head is die cast.

30. The cylinder head assembly of claim 16 wherein the cylinder head comprises aluminum.

31. A small, four cycle internal combustion engine comprising:

a piston reciprocable in a cylinder block and operatively connected to actuate an intake valve and an exhaust valve;

a cylinder head cooperating with the cylinder block;

a rocker box connected to the cylinder head so as to define a passage therebetween allowing air to flow completely through the passage;

a pair of push rod tubes extending between the rocker box and the crank case, said push rod tubes being integrally formed as part of the rocker box; and the cylinder head having cooling fins projecting into the passage between the cylinder head and the rocker box and aligned generally transversely to a line extending between the axes of the intake and exhaust valves, the passage extending essentially in a straight line.

32. The cylinder head assembly of claim 31 further comprising an intake port and an exhaust port formed in the cylinder head, the passage extending between the intake port and the exhaust port.

33. The cylinder head assembly of claim 32 wherein the cylinder head has an exhaust gas recirculation port extending between the intake and the exhaust ports and generally below the passage.

34. The cylinder head assembly of claim 31 wherein the push rod tubes extend externally of the cylinder block.

35. The cylinder head assembly of claim 31 wherein the rocker box has a first pair of holes therethrough adapted to receive means for connecting the rocker box to the cylinder head.

36. The cylinder head assembly of claim 35 wherein the rocker box is bolted to the cylinder head.

37. The cylinder head assembly of claim 31 wherein the rocker box has a second pair of holes therethrough adapted to respectively receive a pair of valve guides projecting from the cylinder head.

38. The cylinder head assembly of claim 31 wherein the rocker box has cooling fins disposed at least partially around its perimeter.

39. The cylinder head assembly of claim 31 wherein the rocker box is die cast.

40. The cylinder head assembly of claim 31 wherein the rocker box comprises aluminum.

41. The cylinder head assembly of claim 31 wherein the rocker box comprises magnesium.

42. The cylinder head assembly of claim 31 wherein the cylinder head is die cast.

43. The cylinder head assembly of claim 31 wherein the cylinder head comprises aluminum.

44. A small, four cycle internal combustion engine comprising:

a piston reciprocable in a cylinder block and operatively connected through a crankshaft disposed in a crankcase with an intake valve and an exhaust valve;

a die cast cylinder head cooperating with the cylinder block;

a die cast rocker box connected to the cylinder head so as to define a passage therebetween allowing air to flow completely through the passage, the rocker box having integrally formed therewith a pair of elongated push rod tubes extending to sealingly cooperate with the crankcase;

the cylinder head having cooling fins projecting into the passage between the cylinder head and the rocker box and aligned generally transversely to a line extending between the axes of the intake and exhaust valves.

* * * * *